United States Patent [19]

Holtermann

[11] Patent Number: 4,890,587

[45] Date of Patent: Jan. 2, 1990

[54] FUEL RESIDUAL HANDLING SYSTEM

[75] Inventor: Theodore J. Holtermann, Brookfield, Wis.

[73] Assignee: Outboardmarine Corporation, Waukegan, Ill.

[21] Appl. No.: 150,226

[22] Filed: Jan. 29, 1988

[51] Int. Cl.[4] ..... F02B 33/04; F02M 25/00

[52] U.S. Cl. ..... 123/73 A; 123/73 B; 123/195 HC

[58] Field of Search ..... 123/195 HC, 73 B, 73 PP, 123/73 A, 73 AV, 73 SC

[56] References Cited

U.S. PATENT DOCUMENTS

| | | | |
|---|---|---|---|
| 1,733,431 | 10/1929 | Sherman . | |
| 2,502,968 | 4/1950 | Lundquist et al. | 123/119 |
| 2,682,259 | 6/1954 | Watkins | 123/73 |
| 2,717,584 | 9/1955 | Upton | 123/119 |
| 2,781,632 | 2/1957 | Meijer | 60/24 |
| 2,857,903 | 10/1958 | Watkins | 123/196 |
| 3,128,748 | 4/1964 | Goggi | 123/73 |
| 3,132,635 | 5/1964 | Heidner | 123/73 |
| 3,170,449 | 2/1965 | Goggi | 123/136 |
| 3,528,395 | 9/1970 | Goggi | 123/73 |
| 3,709,202 | 1/1973 | Brown | 123/73 |
| 3,730,149 | 5/1973 | Brown | 123/73 |
| 3,762,380 | 10/1973 | Schultz | 123/73 |
| 3,800,753 | 4/1974 | Sullivan et al. | 123/73 |
| 3,805,751 | 4/1974 | Resnick et al. | 123/73 |
| 3,859,967 | 1/1975 | Turner et al. | 123/73 |
| 3,929,111 | 12/1975 | Turner et al. | 123/73 |
| 4,063,540 | 12/1977 | Pace | 123/119 |
| 4,121,551 | 10/1978 | Turner | 123/59 |
| 4,176,631 | 12/1979 | Kanao | 123/73 |
| 4,180,029 | 12/1979 | Onishi | 123/73 |
| 4,181,101 | 1/1980 | Yamamoto | 123/73 |
| 4,213,431 | 7/1980 | Onishi | 123/73 |
| 4,286,553 | 9/1981 | Baltz et al. | 123/187 |
| 4,359,975 | 11/1982 | Heidner | 123/73 |
| 4,383,503 | 5/1983 | Griffiths | 123/73 |
| 4,590,897 | 5/1986 | Hundertmark | 123/73 V |
| 4,599,979 | 7/1986 | Breckenfeld et al. | 123/73 |
| 4,690,109 | 9/1987 | Ogasahara et al. | 123/73 |
| 4,770,132 | 9/1988 | Sougawa | 123/73 A |

FOREIGN PATENT DOCUMENTS

| | | | |
|---|---|---|---|
| 0022061 | 2/1985 | Japan | 123/195 HC |

*Primary Examiner*—David A. Okonsky

*Attorney, Agent, or Firm*—Michael, Best & Freidrich

[57] ABSTRACT

An internal combustion engine comprising a crankcase, cylinder, a transfer passage communicating between the crankcase and the cylinder and including a first point which is the lowest point in the transfer passage and at which the transfer passage has a first cross-sectional area, and a second point which is spaced from the first point and at which the transfer passage has a second cross-sectional area less than the first cross-sectional area, whereby air flow through the transfer passage establishes a static pressure differential between the first and second points, a sump communicating with the transfer passage at the first point, and a conduit utilizing the static pressure differential for pumping fluid from the sump to the transfer passage.

23 Claims, 1 Drawing Sheet

FUEL RESIDUAL HANDLING SYSTEM

BACKGROUND OF THE INVENTION

This invention relates generally to internal combustion engines and particularly to two-cycle internal combustion engines.

Moving parts within most two-cycle internal combustion engines are lubricated by means of a fuel/oil mixture introduced into the engine's crankcase during engine operation. Although the fuel/oil mixture is in the form of a droplet cloud or mist when it is introduced into the crankcase, a portion of the mist condenses to form a lubricating film on various moving and stationary surfaces within the crankcase. The thickness of the lubricating film thus formed is dependent upon various factors such as engine and fuel temperature, the air/fuel ratio, the fuel/oil ratio, and the velocity of air flow through the crankcase.

When a two-cycle engine is shut down or stopped, residual fuel runs off the walls and other surfaces within the engine and collects at the lowest point in the crankcase. In horizontal-cylinder, loop scavenged, two-cycle engines, such as are used, for example, in marine outboard motors, a transfer passage communicating with a cylinder combustion chamber is typically provided below each cylinder. Because such a transfer passage often forms the lowest point within the crankcase, it is a likely site for the accumulation of residual fuel, and when the engine is shut down, enough residual fuel can accumulate in the transfer passage to form a significant puddle. During subsequent restarting of the engine, the accumulated puddle can be blown almost instantaneously through the transfer passage into the combustion chamber. Because the accumulated residual fuel cannot be completely burned, a noticeable cloud of smoke is produced at the engine's exhaust outlet.

In one two-cycle internal combustion engine, such as that shown in Griffiths U.S. Pat. No. 4,383,503, a segment of tubing is used in conjunction with a check valve to recirculate residual fuel from the transfer passage to the combustion chamber during engine operation in order to avoid the accumulation of residual fuel while the engine is running. This system will not, however, prevent the accumulation of a residual fuel puddle when the engine is shut down, and smoke can still be produced when the engine is restarted.

In another two-cycle internal combustion engine, such as that shown in Hundertmark U.S. Pat. No. 4,590,897, a sump is provided for collecting residual fuel from the engine crankcase, and a delivery line returns collected residual fuel to the engine when the engine is operating above a predetermined speed. However, as no provision is made for draining accumulated residual fuel from the transfer passage while the engine is shut down, smoke can still be produced as the accumulated residual fuel is blown into the combustion chamber during a subsequent engine restart.

Attention is also directed to the following U.S. patents:

| Attention is also directed to the following U.S. Pat. Nos.: | | |
|---|---|---|
| 4,690,109 | Ogasahara et al. | Sept. 1, 1987 |
| 4,599,979 | Breckenfeld et al. | July 15, 1986 |
| 4,383,503 | Griffiths | May 17, 1983 |
| 4,359,975 | Heidner | Nov. 23, 1982 |

-continued

| Attention is also directed to the following U.S. Pat. Nos.: | | |
|---|---|---|
| 4,286,553 | Baltz, et al. | Sept. 1, 1981 |
| 4,213,431 | Onishi | July 22, 1980 |
| 4,181,101 | Yamamoto | Jan. 1, 1980 |
| 4,180,029 | Onishi | Dec. 25, 1979 |
| 4,176,631 | Kanao | Dec. 4, 1979 |
| 4,121,551 | Turner | Oct. 24, 1978 |
| 4,063,540 | Pace | Dec. 20, 1977 |
| 3,929,111 | Turner, et al. | Dec. 30, 1975 |
| 3,859,967 | Turner, et al. | Jan. 14, 1975 |
| 3,805,751 | Resnick, et al. | Apr. 23, 1974 |
| 3,800,753 | Sullivan, et al. | Apr. 2, 1974 |
| 3,762,380 | Schultz | Oct. 2, 1973 |
| 3,730,149 | Brown | May 1, 1973 |
| 3,709,202 | Brown | Jan. 9, 1973 |
| 3,528,395 | Goggi | Sept. 15, 1970 |
| 3,170,449 | Goggi | Feb. 23, 1965 |
| 3,132,635 | Heidner | May 12, 1964 |
| 3,128,748 | Goggi | Apr. 14, 1964 |
| 2,857,903 | Watkins | Oct. 28, 1958 |
| 2,781,632 | Meijer | Feb. 19, 1957 |
| 2,717,584 | Upton | Sept.13, 1955 |
| 2,682,259 | Watkins | June 29, 1954 |
| 2,502,968 | Lundquist, et al. | Apr. 4, 1950 |
| 1,733,431 | Sherman | Oct. 29, 1929 |

Attention is also directed to Holtermann et al. U.S. patent application Ser. No. 105,177, filed Oct. 5, 1987 and assigned to the assignee of this application.

SUMMARY OF THE INVENTION

The invention provides an internal combustion engine comprising a crankcase, cylinder, a transfer passage communicating between the crankcase and the cylinder, a sump communicating with the transfer passage, and means for pumping fluid from the sump to the transfer passage.

In one embodiment, the transfer passage includes a first point, and a second point which is spaced from the first point, the sump communicates with the transfer passage at the first point, and the means includes means for pumping fluid from the sump to the transfer passage at the second point.

In one embodiment, the means includes conduit means having a first end communicating with the sump, and a second end communicating with the transfer passage at the second point.

In one embodiment, the pumping means also includes check valve means for preventing fluid flow through the conduit means in the direction from the transfer passage to the sump.

The invention also provides an internal combustion engine comprising a crankcase, cylinder, a transfer passage communicating between the crankcase and the cylinder and including a first point at which the transfer passage has a first cross-sectional area, and a second point which is spaced from the first point and at which the transfer passage has a second cross-sectional area less than the first cross-sectional area, whereby air flow through the transfer passage establishes a static pressure differential between the first and second points, a sump communicating with the transfer passage at the first point, and means utilizing the static pressure differential for pumping fluid from the sump to the transfer passage.

In one embodiment, the means is operable only when the velocity of air flow at the second point is greater than a predetermined velocity.

The invention also provides an internal combustion engine comprising a crankcase, a cylinder, a transfer passage communicating between the crankcase and the cylinder and including a first point at which the transfer passage has a first cross-sectional area, and a second point which is spaced from the first point and at which the transfer passage has a second cross-sectional area less than the first cross-sectional area, a sump communicating with the transfer passage at the first point, and conduit means having a first end communicating with the sump, and a second end communicating with the transfer passage at the second point.

The invention also provides an internal combustion engine comprising a crankcase, a cylinder, a first transfer passage communicating between the crankcase and the cylinder and including a first point, a second transfer passage communicating between the crankcase and the cylinder and including a second point, such that air flow through the first and second transfer passages establishes a static pressure differential between the first and second points, a sump communicating with the first transfer passage at the first point, and means utilizing the static pressure differential for pumping fluid from the sump to the second transfer passage.

The invention also provides an internal combustion engine comprising a crankcase, cylinder, an area in which residual fluid accumulates, a transfer passage communicating between the crankcase and the cylinder and including a constricted portion, and conduit means communicating between the constricted portion and the area for conducting fluid from the area to the constricted portion of the transfer passage.

The invention also provides an internal combustion engine comprising a crankcase, a cylinder, a first transfer passage communicating between the crankcase and the cylinder and including a first point, a second transfer passage communicating between the crankcase and the cylinder, a sump communicating with the first transfer passage at the first point, and means for pumping fluid from the sump to the second transfer passage.

A principal feature of the invention is the provision of an internal combustion engine comprising a transfer passage including a first point which is the lowest point in the transfer passage and at which the transfer passage has a first cross-sectional area, and a second point which is spaced from the first point and at which the transfer passage has a second cross-sectional area less than the first cross-sectional area, a sump communicating with the transfer passage at the first point, and means utilizing the static pressure differential between the first and second points for pumping fluid from the sump to the transfer passage.

Another principal feature of the invention is the provision of an internal combustion engine comprising a first transfer passage including a first point which is the lowest point in the first transfer passage, a second transfer passage including a second point, a sump communicating with the first transfer passage at the first point, and means utilizing the static pressure differential between the first and second points for pumping fluid from the sump to the second transfer passage.

Another principal feature of the invention is the provision of a fuel residual handling system that involves only one cylinder. It does not require cylinder-to-cylinder or crankcase-to-crankcase connections. Also, it does not require an external control valve.

Another principal feature of the invention is the use of a constricted portion or venturi in a transfer passage for pumping residual fuel into the transfer passage.

Other features and advantages of the invention will become apparent to those skilled in the art upon review of the following detailed description, claims and drawings.

Figure 1:
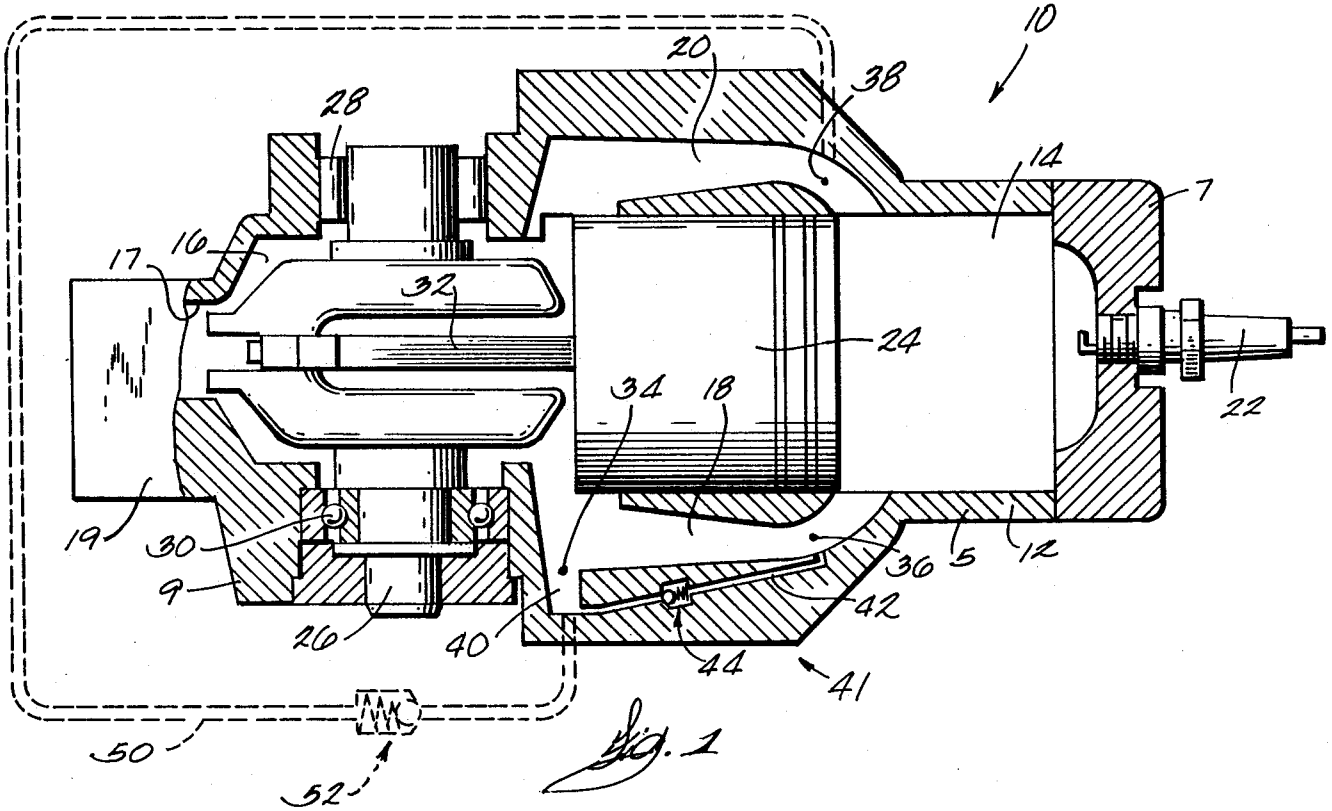
FIG. 1 is a side elevational view, partially in cross section, of an internal combustion engine embodying the invention.

Before one embodiment of the invention is explained in detail, it is to be understood that the invention is not limited in its application to the details of construction and the arrangements of illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An internal combustion engine 10 embodying the invention is illustrated in the drawing. More particularly, the engine 10 is a two-cycle, single-cylinder engine. Furthermore, the engine 10 is preferably a loop-scavenged engine. Such an engine is well suited for use in a marine propulsion device such as an outboard motor. It will be appreciated, however, that the engine 10 is also suited for use in other applications.

The engine 10 comprises an engine block 12 defining a cylinder 14 and a crankcase 16. While various suitable constructions can be employed, in the preferred embodiment, the engine block 12 includes a main portion 5, a cylinder head 7 cooperating with the main portion 5 to define the cylinder 14, and a crankcase cover 9 cooperating with the main portion 5 to define the crankcase 16. The crankcase 16 includes an inlet 17, and suitable means such as a carburetor 19 can be employed for introducing a fuel/oil mixture into the air drawn into the crankcase 16 through the inlet 17. The engine 10 also comprises a spark plug 22 supported by the engine block 12, a piston 24 slideably housed within the cylinder 14, a crankshaft 26 rotatably supported within the crankcase 16 by suitable means such as bearings 28 and 30, and a connecting rod 32 connecting the piston 24 to the crankshaft 26 for causing rotation of the crankshaft 26 in response to reciprocation of the piston 24.

The engine 10 also comprises three transfer passages 18 and 20 (only two are shown) communicating between the crankcase 16 and the cylinder 14. The lower transfer passage 18 is located below both the cylinder 14 and the crankcase 16 and includes a first point 34 which is the lowest point in the transfer passage 18 and at which the transfer passage 18 has a first cross-sectional area. The lower transfer passage 18 also includes a constricted portion including a second point 36 which is spaced from the first point 34 and at which the transfer passage 18 has a second cross-sectional area less than the first cross-sectional area. More particularly, the lower transfer passage 18 forms a venturi at the second point 36. In the preferred embodiment, the point 36 is located adjacent or near the cylinder 14, the cross-sectional area of the transfer passage 18 generally continuously increases from the point 36 toward the crankcase 16, and the point 34 is located adjacent the crankcase 16. The upper transfer passage 20 includes a constricted portion including a point 38 at which the upper transfer passage 20 has a cross-sectional area less than the first cross-sectional area. Preferably, the upper transfer passage 20 forms a venturi at the point 38.

Because of the different areas of the transfer passage 18 at the first and second points 34 and 36, air flow through the transfer passage 18 establishes, during at least a portion of the engine cycle, a static pressure or pressure head differential between the first and second points 34 and 36, with the static pressure being greater at the first point 34. It should be noted that static pressure or pressure head is to be distinguished from dynamic pressure or velocity head. The static pressure differential increases as the velocity of air flow through the transfer passage 18 increases. Because of the difference between the area of the upper transfer passage 20 at the point 38 and the area of the lower transfer passage 18 at the first point 34, air flow through the upper and lower transfer passages 20 and 18 also establishes a static pressure differential between the points 34 and 38.

It should be understood that while the area of the upper transfer passage 20 at the point 38 is preferably less than the area of the lower transfer passage 18 at the point 34, the upper transfer passage 20 could be larger than the lower passage 18 so that the area of the upper passage 20 at the point 38, while being the minimum (or at least less than the maximum) area of the passage 20, could be greater than the area of the lower passage 18 at the point 34.

Because the lower transfer passage 18 includes the lowest point within the engine block 12, the lower transfer passage 18 is the most likely location for accumulation of residual fuel/oil mixture within the engine block 12 after the engine 10 is shut down. Accordingly, the engine 10 also comprises a sump 40 communicating with the lower transfer passage 18 at the first or lowest point 34, and means for pumping fluid, i.e., fuel/oil mixture, from the sump 40 to the transfer passage 18 at the second point 36. While various suitable pumping means can be used, in the preferred embodiment, the pumping means includes means 41 utilizing the above-described static pressure differential between the points 34 and 36 for pumping fluid from the sump 40 to the transfer passage 18. While various suitable means 41 can be employed, in the preferred embodiment, the means 41 includes conduit means 42 having a first end communicating with the sump 40, and a second end communicating with the transfer passage 18 at the second point 36. Preferably, the means 41 further includes check valve means 44 for preventing fluid flow through the conduit means 42 in the direction from the transfer passage 18 to the sump 40.

Alternatively stated, the engine 10 comprises an area in which residual fluid (i.e. fuel/oil) accumulates, and conduit means communicating between the area of fluid accumulation and the constricted portion or venturi of the passage 18 and utilizing the static pressure differential caused by the constricted portion for conducting residual fluid to the constricted portion of the passage 18. While in the preferred embodiment the area of fluid accumulation is in the transfer passage 18, it should be understood that the area could be in other locations, such as in the crankcase 16 or in another transfer passage.

In the preferred embodiment, the pumping means is operable only when the velocity of air flow through the lower transfer passage 18 is greater than a predetermined velocity. In other words, the pressure differential required to pump fluid from the sump 40 to the transfer passage 18 occurs only when the velocity of air flow through the passage 18 is above a predetermined velocity. Preferably, the predetermined velocity occurs only when the engine 10 is running at or near wide-open throttle, at which speed reintroduction of the fuel/oil mixture into the transfer passage 18 will not negatively affect engine operation or result in smoky exhaust. The predetermined velocity, i.e., the velocity required to pump fluid from the sump 40 to the transfer passage 18 at the second point 36, can be varied by varying the relative areas at the first and second points 34 and 36.

When the engine 10 is stopped, residual fuel/oil mixture drains into the lower transfer passage 18 and then into the sump 40. When the engine 10 is restarted, the air flow through the transfer passage 18 establishes the above-described static pressure differential. When the air flow reaches the predetermined velocity, i.e., when the engine 10 is operating at the desired speed, the static pressure differential is great enough to pump fuel/oil mixture from the sump 40 to the transfer passage 18 at the second point 36. Once in the transfer passage 18, the fuel/oil mixture is carried into the cylinder 14 where it is burned during normal engine operation.

An alternative embodiment of the invention is also illustrated in the drawing. In the alternative embodiment, which is illustrated in dotted lines, the engine 10 includes means utilizing the static pressure differential between the first point 34 in the lower transfer passage 18 and the point 38 in the upper transfer passage 20 for pumping fluid from the sump 40 to the upper transfer passage 20. While various suitable pumping means can be employed, in the illustrated construction, such means 50 includes conduit means having a first end communicating with the sump 40, and a second end communicating with the upper transfer passage 20 at the point 38. Preferably, the pumping means also includes check valve means 52 for preventing fluid flow through the conduit means 50 in the direction from the upper transfer passage 20 to the sump 40, and the pumping means is operable only when the velocity of air flow through the passage 20 is greater than a predetermined velocity.

Alternatively stated, the first point 34 constitutes an area in which residual fluid accumulates, and the engine 10 comprises conduit means communicating between the area and the constricted portion of the transfer passage 20 for conducting residual fluid from the area to the constricted portion of the passage 20.

It should be noted that it is preferable, although not absolutely necessary, to locate the venturis or points 36 and 38 adjacent the cylinder ends of the transfer passages 18 and 20. This construction has at least two advantages. First, provision of a venturi at the cylinder end of a transfer passage improves engine performance. Second, this arrangement causes fuel/oil mixture to be reintroduced into the transfer passage 18 downstream of the sump 40, so that the mixture is not likely to flow back into the sump 40.

Various features of the invention are set forth in the following claims.

I claim:

1. An internal combustion engine comprising a crankcase, cylinder, a transfer passage communicating between said crankcase and said cylinder, a sump communicating with said transfer passage independently of the communication of said transfer passage with said crankcase, and means for pumping fluid from said sump to said transfer passage.

2. An engine as set forth in claim 1 wherein said transfer passage includes a first point, and a second point which is spaced from said first point, wherein said sump communicates with said transfer passage at said first point, and wherein said means includes means for pumping fluid from said sump to said transfer passage at said second point.

3. An engine as set forth in claim 2 wherein said pumping means includes conduit means having a first end communicating with said sump, and a second end communicating with said transfer passage at said second point.

4. An engine as set forth in claim 3 wherein said pumping means also includes check valve means for preventing fluid flow through said conduit means in the direction from said transfer passage to said sump.

5. An engine as set forth in claim 1 wherein said means is operable only when the velocity of air flow through said transfer passage is greater than a predetermined velocity.

6. An internal combustion engine comprising a crankcase, cylinder, a transfer passage communication between said crankcase and said cylinder and including a first point at which said transfer passage has a first cross-sectional area, and a second point which is spaced from said first point and at which said transfer passage has a second cross-sectional area less than said first cross-sectional area, whereby air flow through said transfer passage establishes a static pressure differential between said first and second points, a sump communicating with said transfer passage at said first point and independently of the communication of said transfer passage with said crankcase, and means utilizing said static pressure differential for pumping fluid from said sump to said transfer passage.

7. An engine as set forth in claim 6 wherein said means is operable only when the velocity of air flow through said transfer passage is greater than a predetermined velocity.

8. An engine as set forth in claim 6 wherein said pumping means includes conduit means having a first end communicating with said sump, and a second end communicating with said transfer passage at said second point.

9. An engine as set forth in claim 8 wherein said pumping means also includes check valve means for preventing fluid flow through said conduit means in the direction from said transfer passage to said sump.

10. An internal combustion engine comprising a crankcase, a cylinder, a transfer passage communicating between said crankcase and said cylinder and including a first point at which said transfer passage has a first cross-sectional area, and a second point which is spaced from said first point and at which said transfer passage has a second cross-sectional area less than said first cross-sectional area, a sump communicating with said transfer passage at said first point and independently of the communication of said transfer passage with said crankcase, and conduit means having a first end communicating with said sump, and a second end communicating with said transfer passage at said second point.

11. An engine as set forth in claim 10 and further comprising check valve means for preventing fluid flow through said conduit means in the direction from said transfer passage to said sump.

12. An internal combustion engine comprising a crankcase, a cylinder, a first transfer passage communicating between said crankcase and said cylinder and including a first point, a second transfer passage communicating between said crankcase and said cylinder and including a second point, such that air flow through said first and second transfer passages establishes a static pressure differential between said first and second points, a sump communicating with said first transfer passage at said first point and independently of the communication of said transfer passage with said crankcase, and means utilizing said static pressure differential for pumping fluid from said sump to said second transfer passage.

13. An engine as set forth in claim 12 wherein said means is operable only when the velocity of air flow through said second transfer passage is greater than a predetermined velocity.

14. An engine as set forth in claim 12 wherein said first transfer passage has a first cross-sectional area at said first point, and wherein said second transfer passage has a second cross-sectional area less than said first cross-sectional area at said second point.

15. An engine as set forth in claim 12 wherein said pumping means includes conduit means having a first end communicating with said sump, and a second end communicating with said second transfer passage at said second point.

16. An engine as set forth in claim 15 wherein said pumping means also includes check valve means for preventing fluid flow through said conduit means in the direction from said second transfer passage to said sump.

17. An internal combustion engine comprising a crankcase, cylinder, an area in which residual fluid accumulates, a transfer passage communicating between said crankcase and said cylinder and including a constricted portion, and conduit means independent of the communication of said transfer passage with said crankcase and communicating between said constricted portion and said area for conducting residual fluid from said area to said constricted portion of said transfer passage.

18. An engine as set forth in claim 17 wherein said means is operable only when the velocity of air flow through said transfer passage is greater than a predetermined velocity.

19. An engine as set forth in claim 17 and further comprising check valve means for preventing fluid flow through said conduit means in the direction from said constricted portion to said one of said crankcase and said first point.

20. An engine as set forth in claim 17 wherein said crankcase includes said area.

21. An engine comprising a crankcase, cylinder, a transfer passage communicating between said crankcase and said cylinder and including a constricted portion and an area in which residual fluid accumulates, and conduit means communicating between said constricted portion and said area for conducting residual fluid from said area of said transfer passage to said constricted portion of said transfer passage.

22. An engine as set forth in claim 17 and further comprising a second transfer passage communicating between said crankcase and said cylinder and including said area.

23. An internal combustion engine comprising a crankcase, a cylinder, a first transfer passage communicating between said crankcase and said cylinder, a second transfer passage communicating between said crankcase and said cylinder, a sump communicating with said first transfer passage independently of the communication of said transfer passage with said crankcase, and means for pumping fluid from said sump to said second transfer passage.

* * * * *